US010119273B2

(12) United States Patent
Andres et al.

(10) Patent No.: US 10,119,273 B2
(45) Date of Patent: Nov. 6, 2018

(54) SYSTEM FOR SECURING SLATS FOR FORMING A RAISED FLOOR OR DECK

(71) Applicant: ARCHITECTURE DU BOIS, Niedermodern (FR)

(72) Inventors: Wilfried Andres, Niedermodern (FR); Eric Jung, Printzheim (FR)

(73) Assignee: Architecture Du Bois, Niedermodern (FR)

( * ) Notice: Subject to any disclaimer, the term of this patent is extended or adjusted under 35 U.S.C. 154(b) by 0 days.

(21) Appl. No.: 15/125,482

(22) PCT Filed: Mar. 19, 2015

(86) PCT No.: PCT/FR2015/050685

§ 371 (c)(1),
(2) Date: Dec. 28, 2016

(87) PCT Pub. No.: WO2015/140475

PCT Pub. Date: Sep. 24, 2015

(65) Prior Publication Data

US 2017/0254077 A1 Sep. 7, 2017

(30) Foreign Application Priority Data

Mar. 21, 2014 (FR) ..... 14 52398

(51) Int. Cl.
*E04B 5/02* (2006.01)
*E04F 15/02* (2006.01)
(Continued)

(52) U.S. Cl.
CPC ..... *E04B 5/023* (2013.01); *E04B 1/0038* (2013.01); *E04F 13/0819* (2013.01);
(Continued)

(58) Field of Classification Search
CPC .. E04B 5/023; E04B 1/0038; E04F 15/02458; E04F 15/02044; E04F 15/02183;
(Continued)

(56) References Cited

U.S. PATENT DOCUMENTS 5,048,448 A * 9/1991 Yoder ..... E02B 3/068 114/263
5,735,097 A * 4/1998 Cheyne ..... B63B 5/06 114/263
(Continued)

FOREIGN PATENT DOCUMENTS

DE 20 2007 002282 U1 6/2008
DE 20 2013 010349 U1 1/2014
(Continued)

*Primary Examiner* — Babajide A Demuren
(74) *Attorney, Agent, or Firm* — Andrew W. Chu; Craft Chu PLLC

(57) ABSTRACT

The system for removably securing slats juxtaposed to form a deck, for example for a terrace, includes fasteners disposed in rows on level floor or joist or beam structure supports oriented perpendicular to the axis of the slats. The fasteners have a device for securing the supports to the slats. A plurality of impermeable channels is disposed parallel for a level floor, or at a rate of one impermeable channel for each joist or beam support. The top surface of the support, a device for removable securing and a device for positioning provided on the profiled section are covered. The fasteners are made of a flexible elastic material, and the device for positioning allows clearance in a direction of an axis of the channel.

10 Claims, 3 Drawing Sheets

(51) Int. Cl.
*E04F 13/08* (2006.01)
*E04B 1/00* (2006.01)
*E04F 15/024* (2006.01)

(52) U.S. Cl.
CPC .. *E04F 15/02044* (2013.01); *E04F 15/02183* (2013.01); *E04F 15/02458* (2013.01); *E04F 2015/021* (2013.01); *E04F 2015/02072* (2013.01); *E04F 2201/042* (2013.01)

(58) Field of Classification Search
CPC ..... E04F 13/0819; E04F 2015/021; E04F 2201/042; E04F 2015/02072
See application file for complete search history.

(56) References Cited

U.S. PATENT DOCUMENTS 6,619,000 B1 * 9/2003 Chiu-Ying ..... E04F 15/04 269/291
8,544,229 B2 * 10/2013 Kilgore ..... E04F 15/02044 52/177
8,745,946 B2 * 6/2014 D'Alessandro ..... E04B 9/183 52/506.05
8,910,442 B2 * 12/2014 Lachevrotiere ... E04F 15/02044 52/489.1
2002/0056238 A1 5/2002 Leines
2014/0260041 A1 * 9/2014 Peck ..... F16B 5/0685 52/489.1
2015/0128519 A1 * 5/2015 Weber ..... E04F 15/02038 52/489.1

FOREIGN PATENT DOCUMENTS

EP 2 369 094 A1 9/2011
EP 2657429 A2 * 10/2013 ..... E04F 15/02044
FR 2 843 414 A1 2/2004
WO 2006011173 A1 2/2006
WO 2007051934 A1 5/2007

* cited by examiner

SYSTEM FOR SECURING SLATS FOR FORMING A RAISED FLOOR OR DECK

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a system for securing slats or strips juxtaposed to form a raised floor or deck, for example a terrace, or more generally a planking, said slats then being fastened on a support structure that may be based on parallel elements of the joist or sleeper type oriented perpendicular to the axis of said slats.

2. Description of Related Art Including Information Disclosed Under 37 CFR 1.97 and 37 CFR 1.98.

Fasteners are arranged in rows on said supports, so as to fasten the juxtaposed slats thereon following a parallel arrangement. These fasteners are designed to replace the traditional fastening by screws, which is restrictive inasmuch as it requires, inter alia, performing precise measurements, pre-drilling, additional drilling to embed the screw heads, etc. The production of a planking by screwing is also long and tedious, the screwing operations having to be done individually. Lastly, another drawback of this type of assembly is aesthetic, since the screws remain visible on the surface of the planking.

That is why it has been proposed to use fasteners that are much easier to implement, and which are for example pre-placed on the support sleepers, these fasteners being configured such that they are able to be fastened in recesses provided to that end in the lower face of the slats. Thus, more specifically, certain fasteners, provided to be made from an elastic material, include a first part forming a base and intended to be fastened to the upper surface of the joists or sleepers, and a second part perpendicular to the first that forming a sort of tenon intended to clip elastically in recesses or mortises formed in the slats.

These fasteners, screwed regularly on the surface of the supports, nevertheless do not eliminate all of the problems that arise when producing such a planking. Thus, the location of the fastening must be calculated, either requiring very precise measuring, or the positioning of these fasteners on a medium that provides their relative positioning in advance and is next fastened on the sleepers. Even when these preliminary operations are done correctly, it is difficult to guarantee assembly without pitfalls, since the support beams, generally made from wood, may deform under the effect of climate conditions, and in particular bad weather, and its usual corollaries: the wood may work and change shape due to changes in temperatures, swelling due to humidity, which may in turn favor the appearance of fungus, etc. The upper surfaces of these wood supports, which are supposed to keep their shape and must in principle be planar initially—which, incidentally, is an additional constraint to be met—in practice do not always correspond to the initial specifications. The sustainability of the structure is also issue, said structure suffering from insufficient protection from weather damage and potentially deteriorating as time goes by.

During the disassembly phase, each of these fasteners—which are often made from plastic—must in practice next be unscrewed individually, for example for maintenance operations or for recycling. This is a restrictive approach that may prove dissuasive.

BRIEF SUMMARY OF THE INVENTION

The system for fastening juxtaposed slats according to the present invention resolves these various deficiencies by proposing a design that ensures effective protection of the support structure in particular from rot and fungus, and thereby improves the durability of the wood. It also greatly facilitates the fastening and disassembly of the slats and fasteners, authorizes functional play in case of deformation of the slats, and lastly guarantees the consistency of important geometric parameters, such as flatness, etc.

Thus, the invention is essentially characterized in that the fastening system includes a plurality of impermeable channels arranged in parallel for a planar floor, or at a rate of one impermeable channel for each support of the joist or sleeper type and then covering the upper surface of said support, removable securing means and positioning means being provided on the channel and on the fasteners made from a flexible elastic material, said positioning means allowing play in the direction of the axis of the channel.

This channel, for example made from aluminum, is consequently rigid and tight with respect to precipitation, and forms a protective cover for the wood of the supports, in particular in its upper part bearing the brunt of the bad weather. In light of the methods for manufacturing this type of channel, for example by extrusion, straightness and flatness are guaranteed. The means for securing the fasteners to said channel being removable, they are easy to disassemble. This structure also resolves the problem of distribution of the slats, since the positioning means are provided in advance, additionally adapted to the particular technical context of wood slats, which may deform, an axial adjustment of the fasteners being possible. These characteristics give the assembly an unequaled ease and flexibility of use.

In the case of the fastening of the channels to a support of the concrete floor or tiled floor type, spacers provide the interface with the floor, for example wedges made from hard rubber.

More specifically, each channel may include two lateral guideways configured to cooperate with at least two tabs forming a hook protruding from the soleplate of each fastener near its longitudinal ends, which elastically clip in said guideways when the soleplate rests on the upper surface of the channel.

The fasteners in practice fasten transversely to the channel, the securing means then being close to both ends of each fastener. The removability in particular follows from the elastic nature of the component material of the fasteners, which allows flexion of the main body and the fastener as well as, more locally, the fastening tabs.

More specifically, said tabs extend from crosspieces connecting the edges of rectangular openings formed in the soleplate, said crosspieces being oriented along the axis of the channel. Due to the flexible material of the fasteners, the crosspieces may experience a certain torsion, which, combined with the flexion of the tabs, is put to good use during the assembly and disassembly phases.

Thus, the tabs include, on their face opposite that provided at the free end with a protruding channel constituting the hook, a fin whereof the lower channel protrudes from the soleplate and comprises a rectangular cutout. This cutout is used to insert a disassembly tool seeking to pivot the fastening tab to unclip it, as will be explained in more detail later.

According to the invention, the positioning means include at least two studs protruding past the soleplate, provided to be inserted in two positioning holes provided in the upper surface of the channel, said studs being situated on either side of two median planes of the fastener, longitudinal and transverse, respectively. The fasteners indeed are, with very few exceptions, symmetrical with a central axis perpendicularly traversing the soleplate and passing through its geometric center, and defined by the two planes above.

More specifically, there can be two studs, each connected by a tongue to a first edge of an opening of the soleplate that is on the one hand parallel to the axis of the channel and on the other hand proximal with a transverse median plane of the fastener, each stud being placed near a second edge of the opening perpendicular to the first edge. This tongue, flexible since it is made from the material of the fastener, allows an axial play in case of transverse expansion or contraction of the slats of the planking. The play is, however, limited by the proximity of the second edge, which constitutes a de facto stop.

According to the invention, the upper surface of the channel includes a planar central rail on which the fasteners rest, topping two lateral planar portions placed at a distance from the upper surface of the rail at least equal to the protrusion of the tabs and fins from the lower surface of the soleplate.

Said channel may also be provided, in a transverse direction, with returns able to cover part of the vertical support faces of the sleeper type, the protection of the wood then being improved, since the coverage is increased. The runoff water can flow without risk of stagnation on the horizontal parts of the wood.

According to one preferred configuration, a central axial groove with a substantially rectangular section is formed in the upper surface of the central rail of the channel, said groove being provided on its opposite vertical walls with a linear threading oriented parallel to the surface of the channel.

The fasteners themselves comprise a through orifice centered, in a transverse direction of the channel, relative to said groove. It is then possible to fasten the fasteners to the channel more sustainably, by using a screw passing through the through orifice and the threads of which engage with the linear threading of the central groove. The fastening is then no longer provided only by the clipping, which nevertheless provides the initial positioning.

The central rail of the channel also includes, on either side of the central groove, two side grooves with a rectangular section with a width at least equal to the diameter of the studs, the upper opening of which is partially closed by recessed rims separated by a slot, in which positioning orifices for the studs are formed.

BRIEF DESCRIPTION OF THE SEVERAL VIEWS OF THE DRAWINGS

The invention will now be described in more detail, in reference to the appended figures.

DETAILED DESCRIPTION OF THE INVENTION

Figure 1:
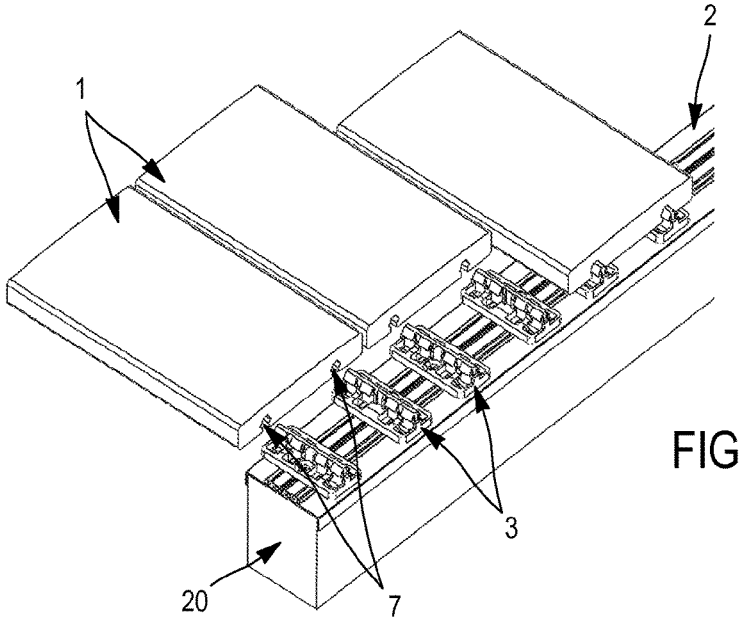
FIG. 1 is a perspective view of a fastening system according to the invention applied to several slats and a support of the sleeper type.

In reference to the figures, and first to FIG. 1, the system for fastening slats (1) according to the invention is made up of a channel (2) topping a sleeper (20) on which fasteners (3) are arranged transversely, in principle regularly.

Figure 2:
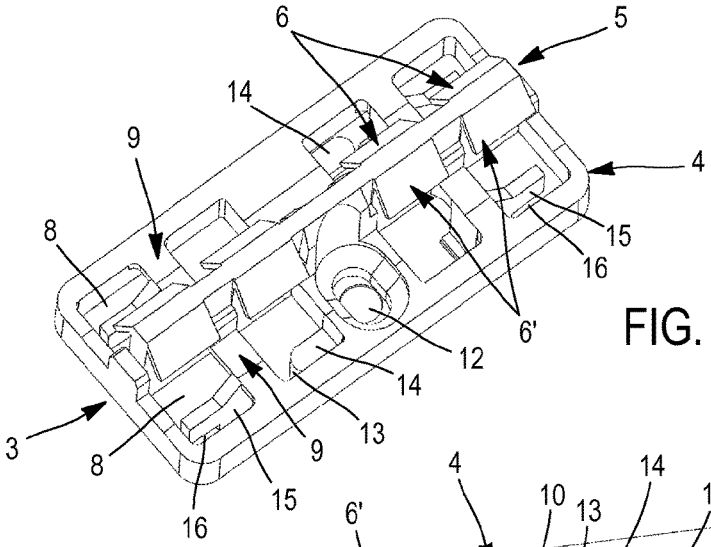
FIG. 2 shows a perspective top view of the fastener.
Figure 3:
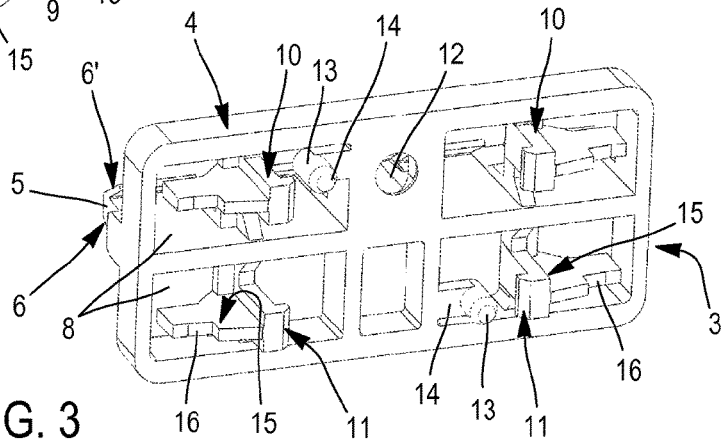
FIG. 3 shows a perspective bottom view of the fasteners.

The fasteners, which can in particular be seen in FIGS. 2 and 3, are made up of two main parts, a soleplate (4) intended to bear against the upper part of the channel (2), protruding from which a fastening portion (5) is deployed substantially perpendicularly, the upper part of which includes oblique lateral rebates (6, 6'), with an arrow shape in cross-section, said portion (5) being configured to be clipped in the recesses with corresponding shapes (7) arranged in the inner surface of the slats (1) in a manner known in itself.

On either side of the portion (5), the soleplate (4) includes rectangular openings (8) crossed by crosspieces (9) to which tabs (10) are fastened provided with a hook-shaped end (11) (see in particular FIG. 3). These tabs (10) protrude from the lower surface of the soleplate (4), which also includes an orifice (12) making it possible, if applicable, to screw the fastener (3) to the channel (2).

Studs (13) appear in two windows (8) situated diagonally in the soleplate (4). These studs are connected via a tongue (14) to the small sides of the proximal openings (8) of the transverse median plane of the fasteners (3), but in the immediate vicinity of a large side.

The tabs (10) include, on their face opposite that which has the hook-forming end portion (11), a fin (15) whereof the lower channel has a rectangular cutout (16).

Figure 4A:
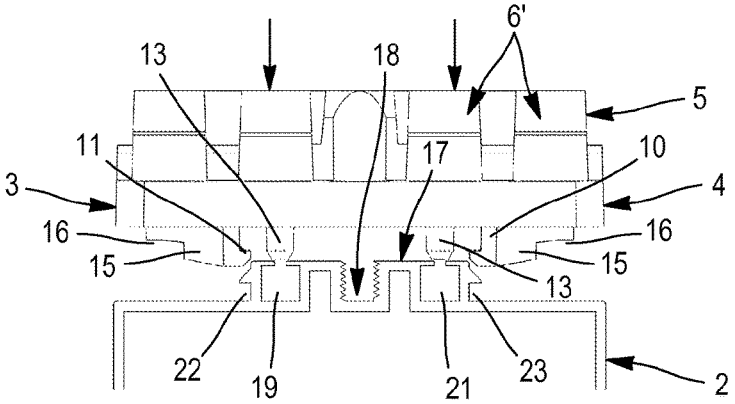
FIG. 4*a* and FIG. 4*b* are cross-sectional views, illustrating the fastening of a fastener on a channel.
Figure 4B:
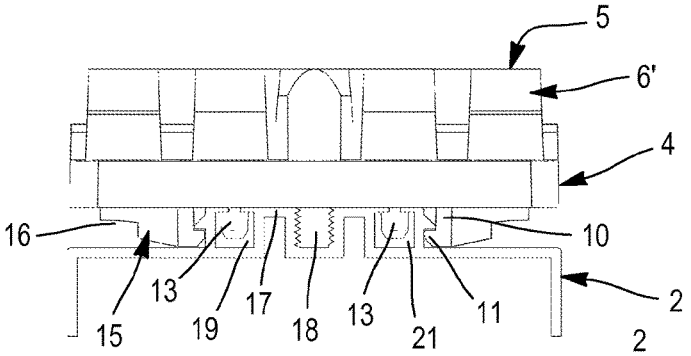

As shown in FIGS. 4*a* and 4*b*, the studs (13) as well as the fins (15) and cutouts (16) protrude from the lower surface of the soleplate (4). The channel (2) includes a central rail (17) provided with three parallel grooves, a central groove (18) and two side grooves (19, 21). These grooves have a rectangular section, and the central groove (18) has a linear threading on both of its vertical faces. The central rail is framed, in cross-section, by two planar portions in which the tabs (10)/fins (15) are deployed.

The threading of the central groove (18) makes it possible, if applicable, to fasten the tab (3) using a screw inserted in the orifice (12) and which can then be fastened in the linear threading when the tab (3) is in the inserted position, as shown in FIG. 4*b*, i.e., with the lower surface of the soleplate (4) in contact with the upper surface of the rail (17). The central groove (18) and the screw inserted in the orifice (12) are a removable securing means for the fastener (3) to the support (20) and channel (2).

FIG. 4*a* shows the fastener (3) before its insertion, the arrows showing the direction and sense of the force to be applied on the fastener (3) to clip it on the channel (2). The passage from one to the other involves equipping the tabs (10) and their hooks (11) in lateral guideways (22, 23) of the central rail (17).

The hook portions (11), as well as the upper part of the lateral guideways (22, 23), include a beveled or oblique surface allowing, like a cam, sliding, then flexion of the tabs (10) so they may be clipped inside the guideways (22, 23).

Figure 5:
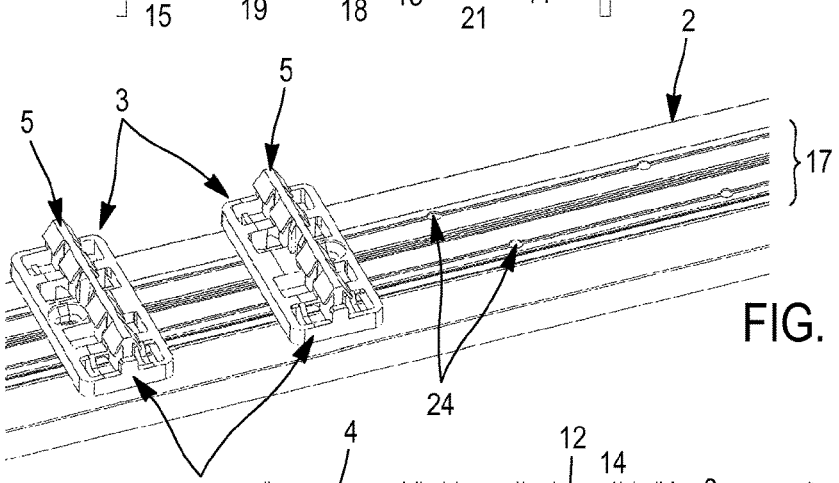
FIG. 5 shows a perspective view of the channel provided with fasteners, a portion of which provided without them shows their positioning orifices.

Simultaneously with this clipping, the studs (13) are inserted in pre-drilled orifices (24), at regular intervals, in the grooves (19, 21), as shown in FIG. 5.

The positioning of the fasteners (3) in the channel (2) is therefore particularly precise. That being the case, and in the case of a deformation of the slats (1), involving either swelling or contraction of the wood, i.e., a transverse deformation of each slat in the direction of an expansion resulting in an increase of its width or a withdrawal that results in a reduction of its width, the fasteners (3) have the possibility of lateral play, as shown in FIG. 6.

Figure 6:
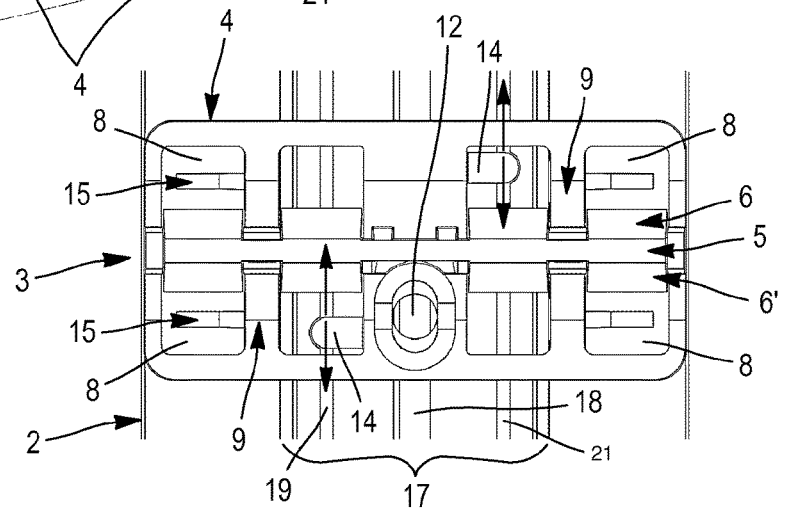
FIG. 6 shows a top plan view of the limitation of the axial functional play.

The arrows appearing in this FIG. 6 show the direction of the contraction or expansion of the slats, allowing a flexion of the tongues (14) until they abut against the edge of the openings (8) near which the studs (13) are situated. These edges limit the flexion and form a stop with respect to the movement, and therefore the possible play.

The tongues (14) can therefore deform in order to allow the fasteners (3) to slide slightly along the channel, thereby preventing deterioration of the fasteners (3) when the wood deforms. The additional advantage of limiting the travel due to the proximity of the studs (13) to the edge of the openings (8) lies in the fact that the wood is kept, despite its expansion or retraction, near its predefined position, which is important in the more general context of the configuration and management of the planking.

Figure 7:
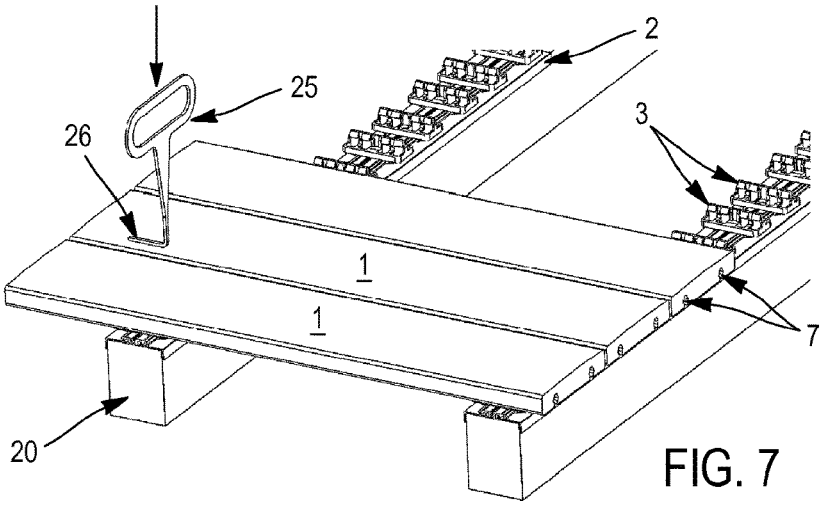
FIGS. 7 and 8 are perspective and section views, respectively, showing how to disassemble the slats of a planking.
Figure 8:
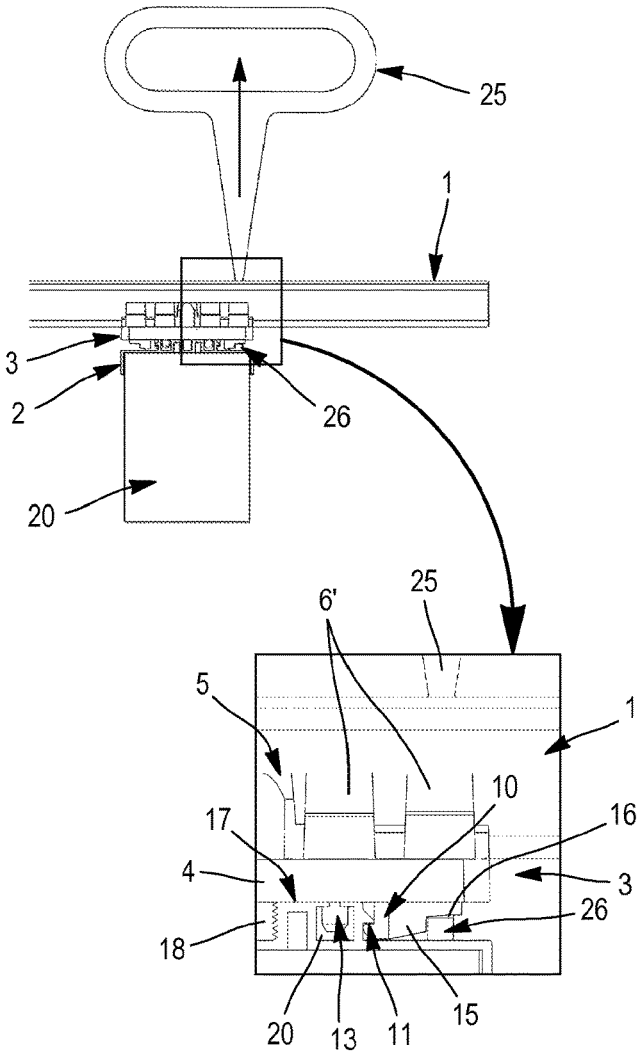

FIG. 7 shows the shape that may be assumed by a disassembly tool (25) provided with an upper part for manipulation by the user and a lower segment (26) provided to engage with the cutouts (16) of the fins (15). The segment (26) is inserted into an interstice separating two adjacent slats (1), then the tool is pivoted by 90° before placing it in the cutout (16) that protrudes below the soleplate (4), as clearly shown in FIG. 4*b*. This movement is possible due to the existence of the offset between the upper surface of the central rail (17) of the channel (2) and the planar portions in which the tabs (10) and the fins (15) are deployed. All that remains is then to exert upward traction as shown by the arrow in FIG. 8 to unlock the hook (11) from the guideway (22) by deformation (flexion) of the tab (10), involving, if applicable, combined twisting of the crosspiece (9). The fastener (3) disassembled from the channel (2) remains in the slat (1), from which it may nevertheless be removed subsequently. The operation may be repeated for the other fasteners, until complete disassembly of the slats (1) from its different supports (20).

The channel (2), for example manufactured from extruded aluminum, is therefore rigid, while the fasteners (3) must of course be made from a flexible and elastic material so that all of the described manipulations are possible.

The invention is not limited to the example described based on the aforementioned figures, but on the contrary encompasses the alternative forms and constitutions within the reach of one skilled in the art.

We claim:

1. A system for a deck, said system comprising:

a slat having a slat longitudinal axis;

a support having a channel, said support having a support longitudinal axis and an upper surface, said channel being positioned on said upper surface, said channel being perpendicular to said slat;

a fastener removably engaged to said slat and slideably engaged on said support, said fastener being slideable along said support longitudinal axis perpendicular to said slat longitudinal axis of said slat;

a removable securing means for said fastener to said support and said channel; and a positioning means for said fastener along said channel and said support longitudinal axis, wherein said channel is comprised of two lateral guideways, wherein said fastener is comprised of a soleplate and at least two tabs, each tab having a downward end protruding downward from said soleplate and a hook at said downward end, and wherein said positioning means comprises said two lateral guideways in removable snap fit engagement with said at least two tabs, each hook clipping in a respective lateral guideway when said soleplate rests on said upper surface of said support.

2. The system for a deck, according to claim 1, wherein said soleplate has rectangular openings and comprises crosspieces connecting edges of said rectangular openings, said crosspieces being aligned along said support longitudinal axis with said channel, each tab extending from a respective crosspiece.

3. The system for a deck, according to claim 2, wherein each tab has a face opposite a respective hook on said downward end, each tab being comprised of a fin protruding from said soleplate, said fin having a protruding channel so as to form said respective hook and a lower channel so as to form a rectangular cutout.

4. The system for a deck, according to claim 1, wherein said channel is further comprised of two side grooves on each side of said removable securing means, each side groove having a corresponding positioning hole, wherein said fastener is further comprised of at least two studs, each stud protruding downward from said soleplate, and wherein said positioning means further comprises said at least two studs removably inserted in two respective positioning holes.

5. The system for a deck, according to claim 4, wherein each stud is connected by a tongue to a first edge of an opening of said soleplate, each tongue extending from a respective first edge parallel to said support longitudinal axis and being proximal to a transverse median plane of said fastener, each stud being placed near a second edge of a respective opening, said second edge being perpendicular to a corresponding first edge.

6. The system for a deck, according to claim 3, wherein said channel further comprises a planar central rail between said two lateral guideways, said planar central rail being an upper channel surface of said channel, said upper channel surface facing said fastener, and two lateral planar portions placed at a distance from said upper channel surface so as to form each lateral guideway, said distance aligning each lateral guideway with a respective tab and fin.

7. The system for a deck, according to claim 1, further comprising a cover attached to said channel in a transverse direction, said cover being positioned over vertical support faces of said support.

8. The system for a deck, according to claim 6, wherein said channel further comprises a central axial groove with a rectangular section in said upper channel surface of said planar central rail, said central axial groove being comprised of opposite vertical walls, each opposite vertical wall having a linear threading oriented parallel to said upper channel surface.

9. The system for a deck, according to claim 4, wherein said channel further comprises a planar central rail between said two lateral guideways, said planar central rail being an upper channel surface of said channel, said upper channel surface facing said fastener and two lateral planar portions placed at a distance from said upper channel surface so as to form each lateral guideway, said distance aligning each lateral guideway with a respective tab and fin, and wherein said two side grooves are on each side of said planar central rail, each side groove having a rectangular section with a width at least equal to a diameter of a respective stud, each positioning hole being comprised of an upper opening partially closed by recessed rims separated by a slot.

10. The system for a deck, according to claim 1, wherein said fastener is comprised of a through orifice centered in a transverse direction across said fastener.

* * * * *